US006851209B2

(12) United States Patent
Lin et al.

(10) Patent No.: US 6,851,209 B2
(45) Date of Patent: Feb. 8, 2005

(54) INTEGRATED ADVERTISEMENT BOARD

(75) Inventors: Jui-Sheng Lin, Tainan (TW); Yuan-Tai Hsieh, Yungkang (TW)

(73) Assignee: Gen-Home Technology Co., Ltd., Tainan (TW)

( * ) Notice: Subject to any disclaimer, the term of this patent is extended or adjusted under 35 U.S.C. 154(b) by 0 days.

(21) Appl. No.: 10/439,244

(22) Filed: May 16, 2003

(65) Prior Publication Data

US 2004/0226201 A1 Nov. 18, 2004

(51) Int. Cl.[7] ..... G09F 13/00

(52) U.S. Cl. ..... 40/442; 40/444; 40/463; 40/541; 40/549; 362/555

(58) Field of Search ..... 40/427, 442, 444, 40/446, 463, 541, 549, 605; 362/812, 555

(56) References Cited

U.S. PATENT DOCUMENTS 4,970,812 A * 11/1990 Tanaka et al. ..... 40/452
5,027,112 A * 6/1991 Ross et al. ..... 345/56
5,268,828 A * 12/1993 Miura ..... 362/249
5,722,760 A * 3/1998 Chien ..... 362/84
5,767,822 A * 6/1998 Hiroshi ..... 345/46
5,900,850 A * 5/1999 Bailey et al. ..... 345/55
6,677,918 B2 * 1/2004 Yuhara et al. ..... 345/1.3
6,698,121 B2 * 3/2004 Wardle et al. ..... 40/452
6,729,054 B1 * 5/2004 VanderTuin ..... 40/452
2003/0185020 A1 * 10/2003 Stekelenburg ..... 362/555

* cited by examiner

*Primary Examiner*—Gary C. Hoge
(74) *Attorney, Agent, or Firm*—Rosenberg, Klein & Lee

(57) ABSTRACT

An integrated advertisement board includes a frame, several light emitting elements arranged on the frame in a form of a matrix, and a controlling circuit electrically connected to the light emitting element; the controlling circuit is used for making each light emitting element emit light and stop emitting light in an alternate way for the light emitting element to present patterns as well as for the patterns to have constantly changing appearance.

45 Claims, 5 Drawing Sheets

INTEGRATED ADVERTISEMENT BOARD

BACKGROUND OF THE INVENTION

1. Field of the Invention

The present invention relates to an integrated advertisement board, more particularly one, which consists of light emitting elements arranged to form a matrix, and a controlling circuit, which can make each of the light emitting elements emit light and stop emitting light in alternate way according to the need of users so that the light emitting elements together can present patterns having changing forms, and that the advertisement board is more attractive and easy to use.

2. Brief Description of the Prior Art

TV, flags, balloons, hats, clothing, flyers, and advertisement boards are used as tools for advertising products, campaigns, activities and so on. Conventionally, advertisement boards are equipped with additional illumination so that information thereon can be clearly seen in the dark. The illumination is usually conventional light bulbs, and fluorescent tubes, which are relatively big in size, and are power consuming. Consequently, the advertisement board occupies much space, and is not economical to use.

To overcome the above disadvantages, light emitting diodes are used as illumination of advertisement boards instead. Light emitting diodes are relatively small in size, consume less power, and have relatively long service life. Conventionally, light emitting diodes are arranged in the form of a particular pattern on an advertisement board so that the pattern can be made clearly visible and attractive with lights of different colors being emitted from the light emitting diodes. However, relatively many LED have to be fitted on the advertisement board to be capable of providing satisfactory illumination as well as a big enough light emitting area to make the advertisement board attractive and fancy because the LED are very small. Consequently, the cost of wiring, assembly and materials of the advertisement boards is so high that such LED equipped advertisement boards are still not competitive, and there is a lot of room for improvement.

SUMMARY OF THE INVENTION

It is a main object of the present invention to provide an integrated advertisement board, which includes many light emitting diodes, which are arranged in the form of a matrix, and each of which has a transparent inner shell and a transparent outer spherical shell; thus, light of each LED can be concentrated to be several times stronger by means of the shells, and in turns, the advertisement board can be equipped with reduced numbers of LED to be economical to use while providing enough light.

The integrated advertisement board includes a frame, on which light emitting elements are arranged, and which consists of several transverse parts arranged one on top of another, and a pair of vertical parts joined to respective ones of two ends of the transverse parts.

The integrated advertisement board is equipped with a controlling circuit, which can make each light emitting element emit light and stop emitting light in an alternate way for the light emitting elements to present patterns having constantly changing appearance. The controlling circuit also can be set up such that different lines of light emitting elements take turns emitting light.

The light emitting element emits have LED, which are tri-color ones, each capable of emitting red, green, and blue lights, and controlling circuit can make strength of the red, green, and blue lights from each LED change according to data stored in a subsidiary memory thereof; thus, patterns are presented with the color of every portion thereof constantly changing.

The controlling circuit is equipped with a light sensing device for finding out whether it is so dark that the advertisement board should be activated for use; the light sensing device can be set up so as to make a chief controller of the controlling circuit stay in either one of both activated status and not-activated status for a predetermined length of time after it has been switching the chief controller on and off in alternate way for predetermined numbers of times during certain portions of a day such as the evening.

The controlling circuit is equipped with first radio receiver and radio transmitter, both connected to the chief controller, and a remote control, which includes second radio transmitter and receiver, is provided for working with the first radio receiver and radio transmitter; thus, data in the memory of the remote control can be transmitted to the chief memory via the second radio transmitter as well as the first radio receiver, and data in the chief memory can be transmitted to the memory of the remote control via the first radio transmitter as well as the second radio receiver, thus making a copy of the data.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 4:
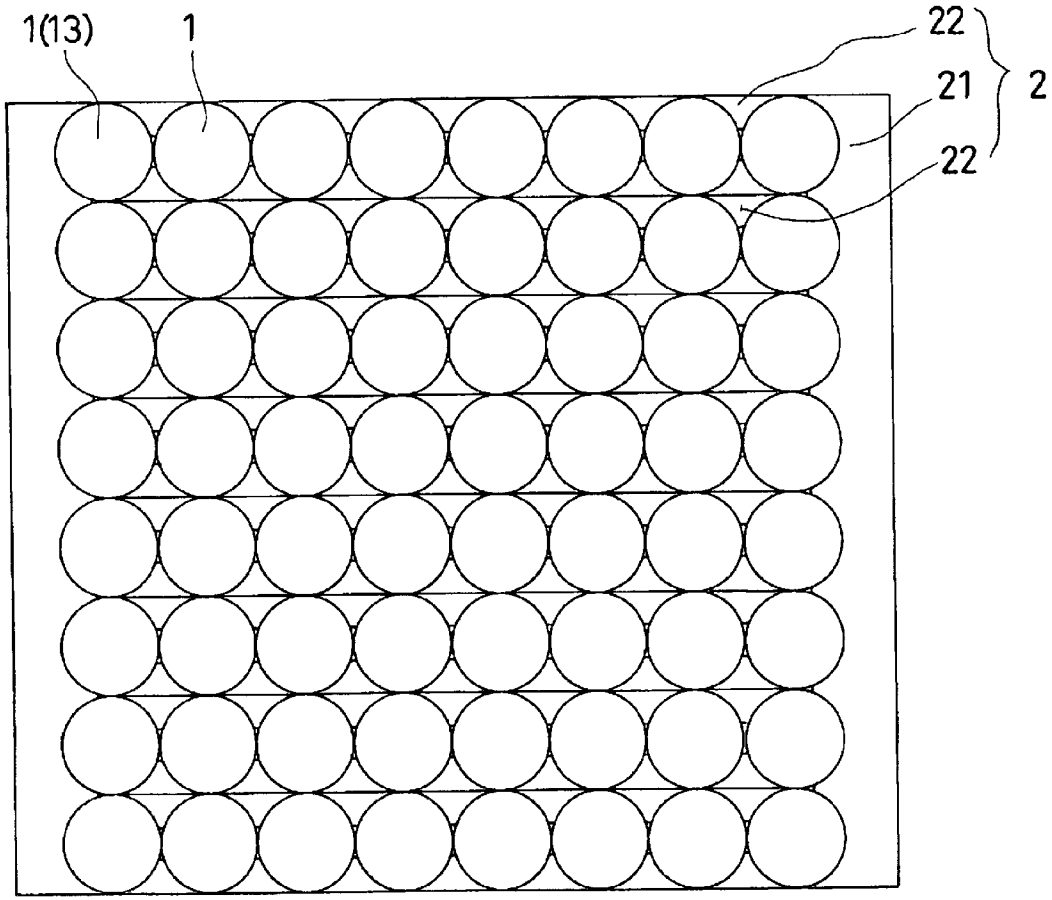
FIG. 4 is a front view of the integrated advertisement board according to the present invention.
Figure 5:
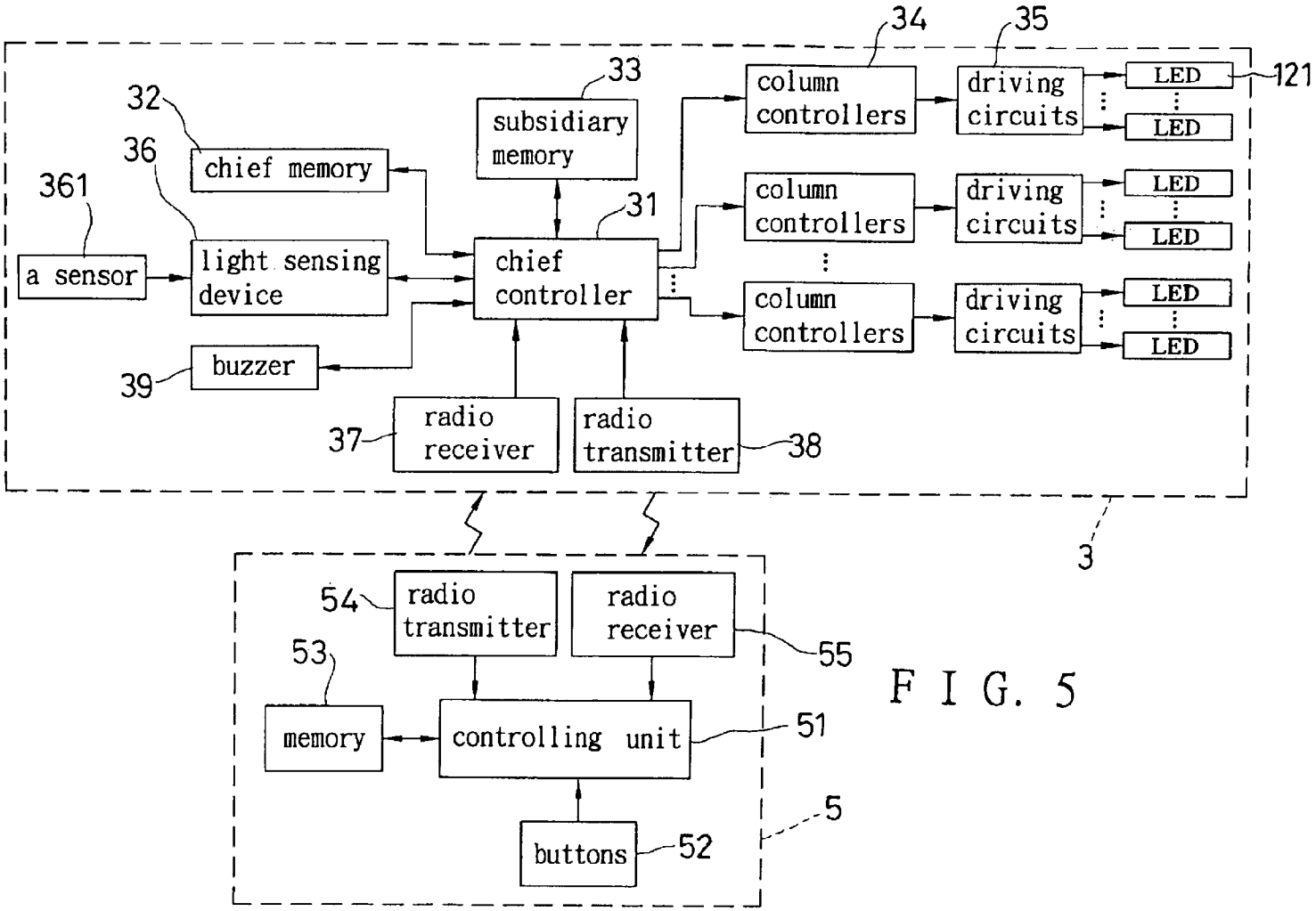
FIG. 5 is a block diagram of the circuit of the integrated advertisement board according to the present invention.

Referring to FIGS. 4, and 5, a preferred embodiment of an integrated advertisement board in the present invention includes light emitting elements 1, a frame 2, and a controlling circuit 3 disposed in the frame. The light emitting elements 1 are arranged on a front side of the frame 2 in the form of a matrix and electrically connected to the controlling circuit 3.

The controlling circuit 3 includes a chief controller 31, a chief memory 32, a subsidiary memory 33, several column controllers 34, driving circuits 35 each connected to one of the column controllers 34, and a light sensing device 36. The chief controller 31 is a microprocessor working as calculation and control center of the whole circuit 3, and the chief memory 32, the subsidiary memory 33, the column controllers 34, and the light sensing device 36 are all electrically connected to the chief controller 31.

The chief memory 32 is used for storing digital data, which are transformed from various patterns to be presented with the light emitting elements 1 on the present advertisement board. The subsidiary memory 33 is used for storing digital data, which are transformed from data related to the colors of various portions of a pattern, and the way of presenting the pattern with the light emitting elements 1.

Each column of the light emitting elements 1 is electrically connected to one of the driving circuits 35 so as to be connected to the column controllers 34. Each light emitting element 1 includes a tri-color (red, green, and blue) light emitting diode, and the driving circuits 35 can make the red, green, and blue lights of each light emitting diode mix together, and make the strength of the red, green, and blue lights change constantly according to data stored in the subsidiary memory 33.

In using the advertisement board, the chief controller 31 gets data from the chief memory 32, and both the subsidiary memory 33 and the column controllers 34 get respective ones of the data to make corresponding ones of the driving circuits 35 function to activate the corresponding column of light emitting elements 1; thus, each light emitting element 1 can begin emitting light and stop emitting light in a particular alternate way, i.e. in a particular pace, and the red, green, and blue lights emitted from each light emitting element 1 are made to change strength by the driving circuits 35 according to data stored in the subsidiary memory 33. Consequently, patterns or characters with constantly changing appearance are presented on the advertisement board with each light emitting element 1 emitting light of constantly changing colors and stopping emitting light in a particular alternate way. The controlling circuit 3 can also be set up such that different lines or different columns of light emitting elements 1 take turns emitting light to show a pattern with changing appearance.

The light sensing device 36 has a sensor 361, e.g. light sensitive resistor, so as to be capable of finding out whether or not sunlight in the environment is less than a predetermined amount, i.e. whether it is so dark that the advertisement board can be used. In the first embodiment, the light sensing device 36 will activate the chief controller 31 in case it finds out that it is dark, and it will make the chief controller 31 stop operating in case it finds out that the environment gets light. In the second embodiment, the light sensing device 36 will activate the chief controller 31 in case it finds out that it is dark, and in turns, the chief controller 31 will operate for a predetermined length of time; the light sensing device 36 will stop activating the chief controller 31 after the predetermined length of time passes. In addition, to prevent the light sensing device 36 from responding to change of amount of light frequently due to the high sensitiveness, the light sensing device 36 is set up such that it will make the chief controller 31 stay either activated or not-activated for at least a predetermined length of time after it has been switching the controller 31 on and off in alternate way for predetermined numbers of times, thus not going to activate and stop activating the controller 31 in alternate way too frequently, e.g. the light sensing device 36 will make the controller 31 stay activated in the evening after the device 36 has been switching the controller 31 on and off in alternate way for predetermined numbers of times due to the change of sunlight in the evening.

The controlling circuit 3 is further equipped with a buzzer 39, a radio receiver 37, and a radio transmitter 38, all connected to the chief controller 31, so that it can be operated with a remote control 5. The remote control 5 consists of a controlling unit 51, buttons 52, a memory 53 such as EEPROM, a radio receiver 55, and a radio transmitter 54. The user can operate the remote control 5 with the buttons 52 to change contents of the chief memory 32 plus transmit contents of the memory 53 of the remote control 5 to the chief memory 32 and vice versa. More specifically, the remote control 5 is operated to transmit new data in the memory 53 to the radio receiver 37 via the radio transmitter 54, and the chief controller 31 will receive the data via the receiver 37, and activate the buzzer 39 for informing the user of the receipt of the data as well as the order. Then, the chief controller 31 will clear the original data in the memory 32, and store the new data in the memory 32; thus, the memory 32 contains data related to new patterns to be presented with the light emitting elements 1 on the advertisement board, and the user doesn't have to walk to the advertisement board or reach for a control panel of the board to change the data. On the other hand, in case the user wants to keep record of data in the memory 32, he operates the remote control 5 to transmit an order to the radio receiver 37 via the radio transmitter 54, and the chief controller 31 will receive the order via the receiver 37, and activate the buzzer 39 for informing the user of the receipt of the order. Then, the controller 31 makes the data in the memory 32 transmitted via the radio transmitter 38, and the radio receiver 55 will receive the data, which are immediately stored in the memory 53; thus, other clients can use the patterns in the future, to which the data are related, in case they are satisfied with the patterns when seeing them.

Figure 1:
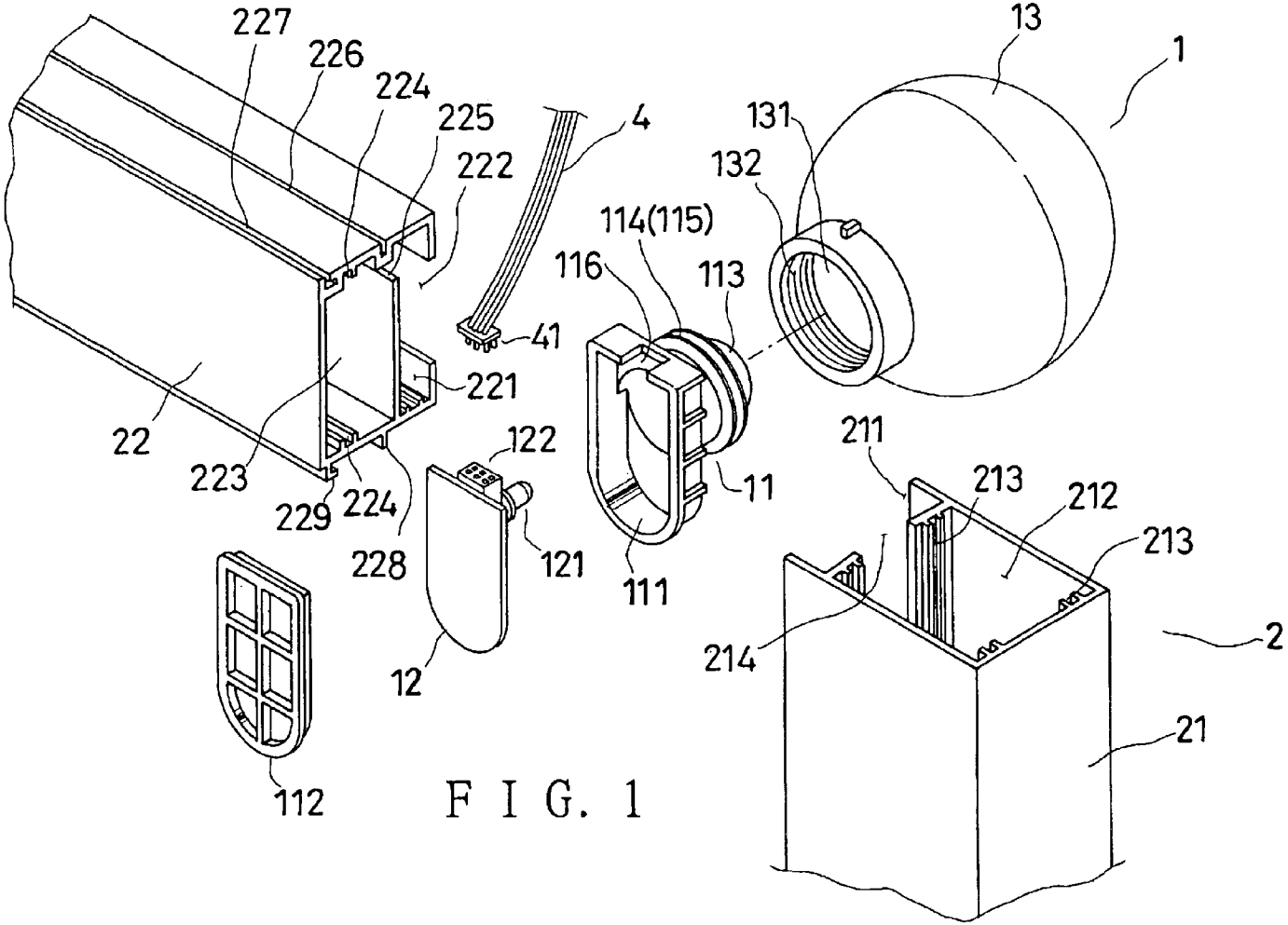
FIG. 1 is a partial exploded perspective view of the integrated advertisement board according to the present invention.
Figure 2:
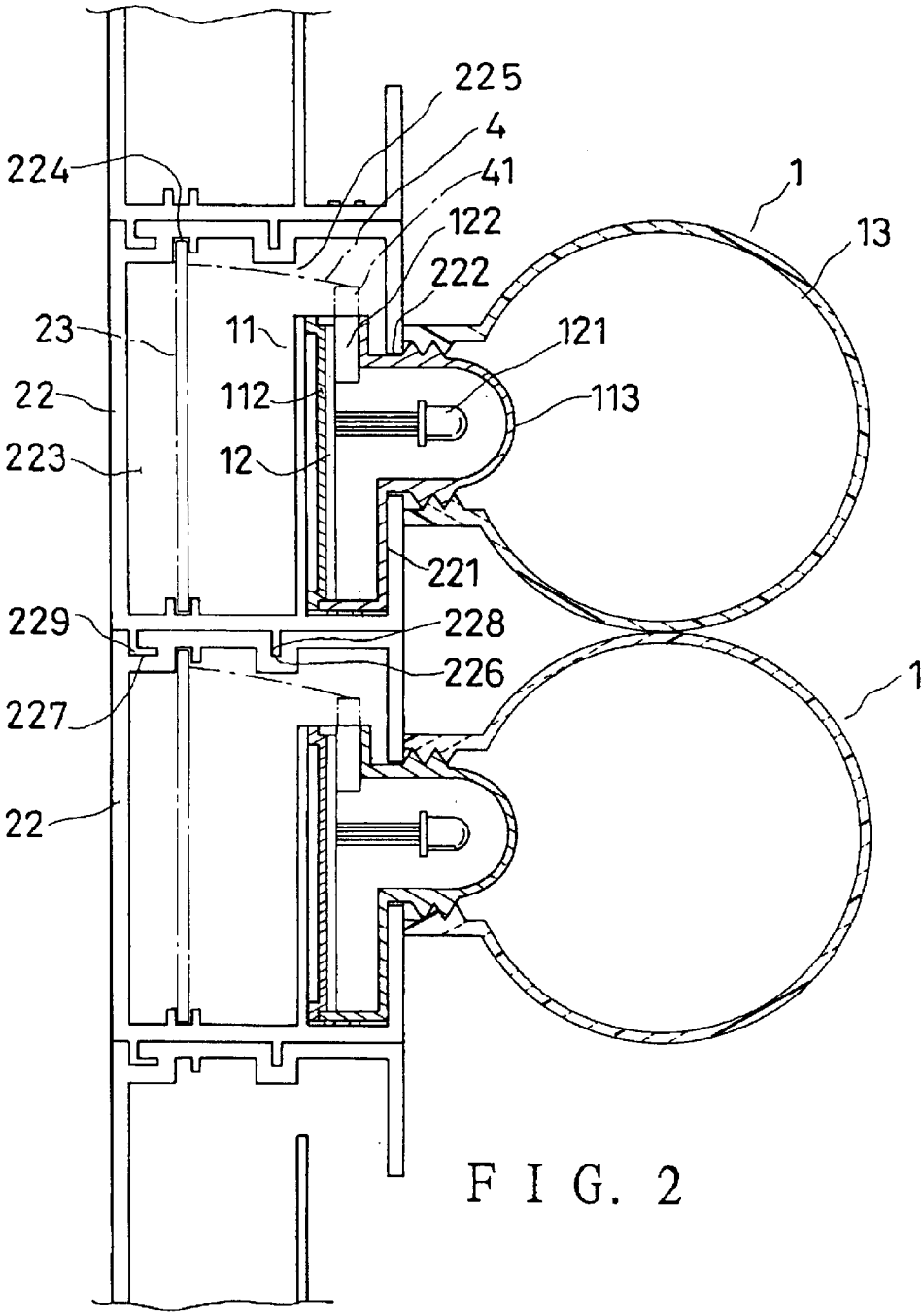
FIG. 2 is a partial vertical cross-sectional view of the integrated advertisement board according to the present invention.
Figure 3:
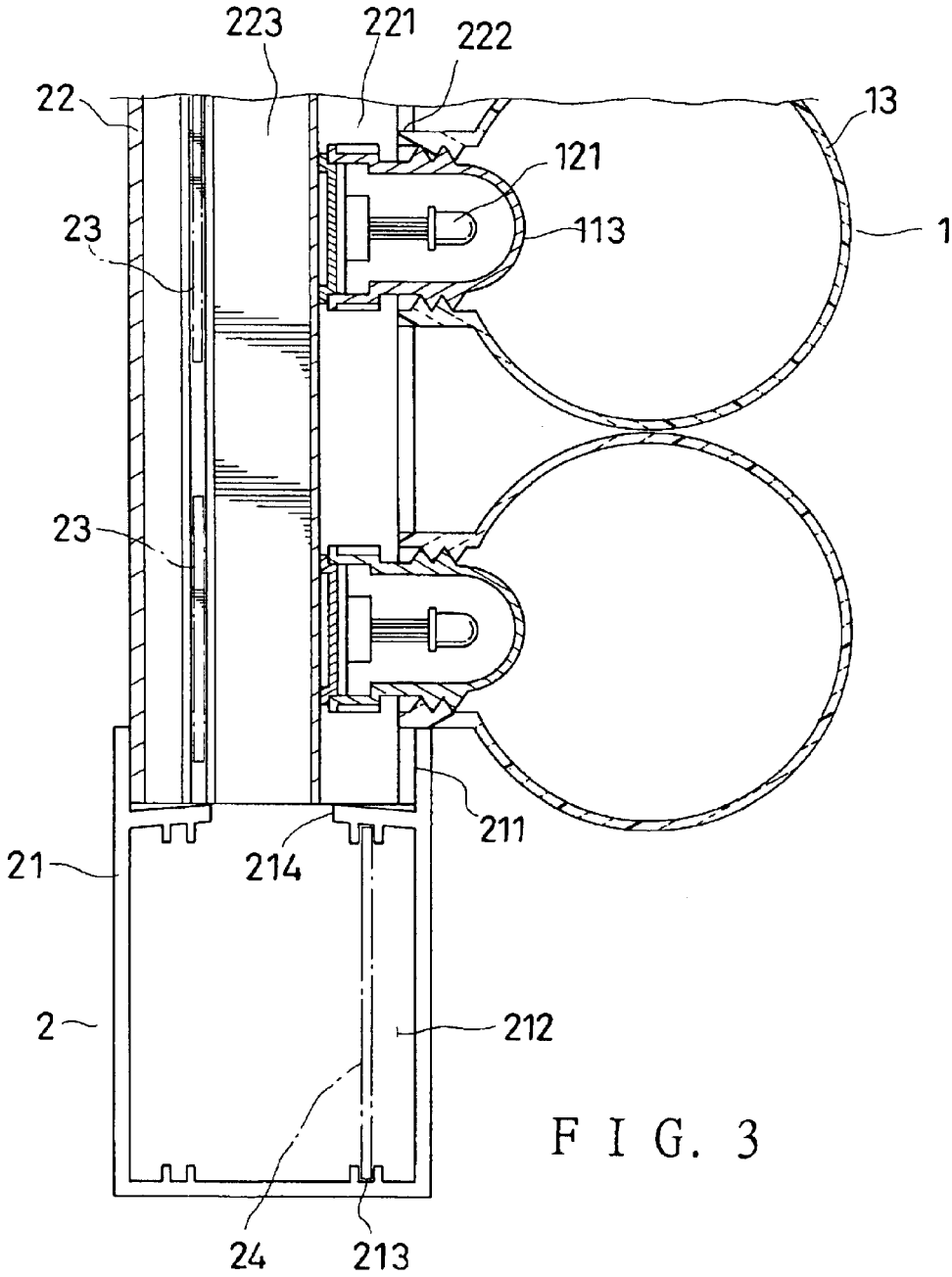
FIG. 3 is a partial horizontal cross-sectional view of the integrated advertisement board according to the present invention.

Furthermore, referring to FIGS. 1 to 3, the frame 2 is comprised of two vertical parts 21, and several transverse parts 22 while several circuit board combinations together form the controlling circuit 3, each of which includes a circuit board 12, a circuit board 23, and a circuit board 24.

More specifically, referring to FIG. 1, each light emitting element 1 consists of a base 11, a circuit board 12, and a transparent outer spherical shell 13; the base 11 has a holding room 111 on a rear side, a cover 112 for covering the holding room 111 with, a gap 116 on a top in communication with the holding room 111, and a transparent inner shell 113 on a front side and in communication with the holding room 111, which has a rear connecting portion 114 formed with threads 115; the circuit board 12 has a light emitting diode 121 joined thereto by means of welding, and a socket 122 also joined thereto by means of welding, and is fitted to the holding room 111 of the base 11 with the light emitting diode 121 being disposed in the inner shell 113 and with the socket 122 projecting from the gap 116; the cover 112 is fitted in position after the circuit board 12 is fitted in the holding room 111 to prevent the circuit board 12 from falling off; the spherical shell 13 has an opening 131, and a threaded portion 132 on an inner side near to the opening 131; the spherical shell 13 is screwed onto the connecting portion 114 of the inner shell 113 at the threaded portion 132 thereof.

Each transverse part 22 of the frame 2 has a front holding room 221, a front gap 222 formed along a front thereof, a rear holding room 223, a middle wall (not numbered) between the front and the rear holding rooms 221 and 223, a pair of opposing insertion trenches 224 formed along the rear holding room 223, a middle gap 225 lengthways formed between the middle wall and the upper portion of the transverse part 22, a connecting groove 226 formed along the top of the transverse part 22, an engaging groove 227, which is also formed along the top, and has an L-shaped vertical section, a connecting protrusion 228 formed along the bottom of the transverse part 22, and an engaging protrusion 229, which is also formed along the bottom of the transverse part 22, and is shaped like the engaging groove 227 for fitting with an engaging groove 227 of a lower transverse part 22.

Certain numbers of light emitting elements 1 are joined to a corresponding transverse part 22 to form a column with the base 11 being held in the front holding room 221, and with the inner shell 113 projecting from the front gap 222. Referring to FIG. 2, circuit boards 23 are inserted into the insertion trenches 224 to be secured in position, and wires 4 are passed through the middle gap 225, and connected to respective circuit boards 23, and the sockets 122 fitted on respective ones of the circuit boards 12.

Each vertical part 21 has a connecting room 211 formed along it, a holding room 212 formed along it, two separating portions (not numbered) between the connecting room 211 and the holding room 212, a gap 214 between the separating portions, and opposing insertion trenches 213 formed in the holding room 212. The transverse parts 22 are joined together, one on top of another, with the connecting protrusions 228, and engaging protrusions 229 being inserted into adjacent connecting grooves 226, and engaging grooves 227 respectively. And, the joined transverse parts 22 are inserted into the connecting rooms 211 of the vertical parts 21 at two lateral edges, and screws are used to secure the former to the latter; thus, the light emitting elements 1 are arranged on the front of the frame 2 to form a matrix as shown in FIG. 4. Afterwards, circuit boards 24 are inserted into the insertion trenches 213 to be secured in position as shown in FIG. 3, and electrically connected to the circuit boards 23 by means of wires (not numbered), which are passed through the gap 214.

Light emitted from each light emitting diode 121 will be made several times stronger by means of the inner shell 113 and the outer spherical shell 13, which can work together to concentrate the light twice. In other words, the advertisement board will be several times lighter than one that is merely equipped with same numbers of light emitting diodes of the same kind.

From the above description, it can be easily understood that the integrated advertisement board of the present invention has advantages as followings:

1. Because the inner shells 113 can work together with corresponding outer spherical shell 13 to concentrate light of the LED 121 to make the light several times stronger, the advertisement board can be equipped with reduced numbers of LED to provide enough light. Therefore, the advertisement board is cheaper to produce and economical to use.

2. The color of light of each LED 121 can meet high standard requirements of clients because the driving circuits 35 can make strength of the red, green, and blue lights of each LED change according to data stored in the subsidiary memory 33. Consequently, patterns or characters with changing appearance are presented on the advertisement board with the color of every portion thereof constantly changing.

3. The light sensing device 36 can function to make the advertisement board work only when it is dark, and can be set up such as to make the chief controller 31 stay either activated or off for a predetermined length of time, thus not going to activate and stop activating the controller 31 in alternate way too frequently at certain time of a day, e.g. the evening.

4. Data in the memory of the advertisement board, which are related to patterns to be presented, can be changed, updated, and cleared by means of a remote control therefore the advertisement board is convenient to use.

5. Data in the chief memory 32 can be reproduced for future use by means of transmitting the data to the radio receiver 55 provided in the remote control 5 via the radio transmitter 38 of the controlling circuit 3, and storing the data in the memory 53.

What is claimed is:

1. An integrated advertisement board, comprising:

a frame;

a plurality of light emitting elements arranged on the frame in a form of a matrix;

a controlling circuit electrically connected to the light emitting elements for making each light emitting element emit light and stop emitting light in an alternate way for the light emitting elements to present patterns with constantly changing appearance; the controlling circuit being capable of being set up such that different lines of light emitting elements take turns emitting light while a pattern is presented; and being characterized by the light emitting elements, each of which consists of:

a base having a holding room on a rear side thereof, and a cover for covering the holding room thereof; the base having a transparent inner shell projecting from a front side thereof and in communication with the holding room; the inner shell having a rear connecting portion;

an LED; the LED being joined to a first circuit board of the controlling circuit by means of welding; the first circuit board being disposed in the holding room with the LED being disposed in the inner shell; and a transparent spherical shell having an opening; the spherical shell being passed over the inner shell at the opening and joined to the rear portion of the inner shell for cooperating with the outer shell to concentrate light emitted from the LED twice.

2. The integrated advertisement board as claimed in claim 1, wherein LED of each light emitting element is a tri-color one, which can emit red, green, and blue lights mixed together; strength of the red, green, and blue lights emitted from each LED being made to change by means of a driving circuit for the LED so that color of the LED changes accordingly.

3. The integrated advertisement board as claimed in claim 1, wherein the rear portion of the inner shell, and the spherical outer shell have threads on inner, and outer sides thereof respectively, and are securely screwed to each other by means of the threads.

4. The integrated advertisement board as claimed in claim 1, wherein each base has a gap in communication with the holding room thereof, and a socket is joined to each first circuit board, and projects from the gap of a corresponding base for connection with a wire connected to other circuit boards of the controlling circuit.

5. The integrated advertisement board as claimed in claim 1, wherein the frame includes a plurality of transverse parts arranged one on top of another, and a pair of vertical parts joined to respective ones of two ends of the transverse parts; each transverse part having a front holding room formed therealong; the bases being held in the front holding rooms; each transverse part having a gap lengthwise formed in front of the front holding room thereof for allowing the inner shells to projecting therefrom; each vertical part having a connecting room; the transverse parts being connected to the connecting rooms at two ends thereof.

6. The integrated advertisement board as claimed in claim 5, wherein each transverse part has a rear holding room formed therealong, and a middle gap between the front and the rear holding rooms, and second circuit boards of the controlling circuit are held in the rear holding rooms, and each vertical part has a holding room, and a gap between the connecting room and the holding room thereof while third circuit boards of the controlling circuit are disposed in the holding rooms of the vertical parts; wires being passed through the middle gap of each transverse part to connect the first circuit boards to the second circuit boards; wires being passed through the gap of each vertical part to connect the second circuit boards to the third circuit boards.

7. The integrated advertisement board as claimed in claim 6, wherein each transverse part has opposing trenches in the rear holding room thereof, and the second circuit boards are tightly inserted into the opposing trenches at edges thereof.

8. The integrated advertisement board as claimed in claim 6, wherein each vertical part has opposing trenches in the holding room thereof, and the third circuit boards are tightly inserted into the opposing trenches at edges thereof.

9. The integrated advertisement board as claimed in claim 5, wherein each transverse part has a connecting protrusion, and an engaging protrusion formed along a bottom thereof, and a connecting groove, and an engaging groove formed along a top thereof, and the transverse parts are joined together, one on top of another, with the connecting protrusions, and engaging protrusions being inserted into adjacent connecting grooves, and adjacent engaging grooves respectively.

10. The integrated advertisement board as claimed in claim 1, wherein the controlling circuit includes:

a chief controller in a form of a microprocessor;

a chief memory electrically connected to the chief controller; the chief memory being used for storing digital data, which are transformed from various patterns to be presented with the light emitting elements; and a plurality of column controllers electrically connected to the chief controller, and respective driving circuits; each driving circuit being connected to a column of light emitting elements; the column controllers being provided to make corresponding driving circuits function to activate corresponding column of light emitting elements such that each light emitting element begins emitting light and stops emitting light in an alternate way, and in turns, patterns are presented on the advertisement board with each light emitting element beginning and stopping emitting light in an alternate way.

11. The integrated advertisement board as claimed in claim 10, wherein the controlling circuit includes a subsidiary memory electrically connected to the chief controller, and every LED is a tri-color one, which can emit red, green, and blue lights; the subsidiary memory being used for storing digital data, which are transformed from data related to colors of various portions of a pattern, and the way of presenting the pattern with the light emitting elements; the driving circuits and the column controllers being capable of working together to make strength of the red, green, and blue lights emitted from each light emitting diode change constantly according to data stored in the subsidiary memory; thus, a pattern is presented with constantly changing colors with the red, green, and blue lights of each light emitting diode mixing together.

12. The integrated advertisement board as claimed in claim 10, wherein a light sensing device is electrically connected to the chief controller for finding out whether it is so dark that the advertisement board should be activated for use, and operates according to a fact found out therewith.

13. The integrated advertisement board as claimed in claim 12, wherein the light sensing device is set up so as to make the chief controller stay in either one of an activated status and a not-activated status for a predetermined length of time after it has been switching the chief controller on and off in an alternate way for predetermined numbers of times, thus not going to activate and stop activating the controller in the alternate way for extended lengths of time during certain portions of a day.

14. The integrated advertisement board as claimed in claim 10, wherein the controlling circuit is equipped with first radio receiver and radio transmitter, both connected to the chief controller, and a remote control is provided for working with the first radio receiver and radio transmitter; the remote control consisting of a controlling unit, a plurality of buttons, a memory, and second radio receiver and radio transmitter, the remote control being operable with the buttons to transmit data in the memory of the remote control to the chief memory via the second radio transmitter as well as the first radio receiver, thus making a copy of the data in the chief memory.

15. The integrated advertisement board as claimed in claim 14, wherein the remote control can be operated with the buttons to transmit data in the chief memory to the memory of the remote control via the first radio transmitter as well as the second radio receiver, thus making a copy of the data in the memory of the remote control.

16. An integrated advertisement board, comprising:

a frame;

a plurality of light emitting elements arranged on the frame in a form of a matrix; and a controlling circuit electrically connected to the light emitting elements for making each light emitting element emit light and stop emitting light in an alternate way for the light emitting elements to present patterns having constantly changing appearance; the controlling circuit being capable of being set up such that different lines of light emitting elements take turns emitting light; and being characterized by the frame, which consists of:

a plurality of transverse parts arranged one on top of another, and a pair of vertical parts joined to respective ones of two ends of the transverse parts;

each transverse part having a front holding room for holding the light emitting elements in position; each vertical part having a connecting room for holding respective ends of the transverse parts in position.

17. The integrated advertisement board as claimed in claim 16, wherein each transverse part has a rear holding room, and a middle gap between the front and the rear holding rooms, and a plurality of second circuit boards of the controlling circuit are held in the rear holding rooms, and each vertical part has a holding room, and a gap between the connecting room and the holding room thereof while a plurality of third circuit boards of the controlling circuit are disposed in the holding rooms of the vertical parts; wires being passed through the middle gap of each transverse part to connect the light emitting elements to the second circuit boards; wires being passed through the gap of each vertical part to connect the second circuit boards to the third circuit boards.

18. The integrated advertisement board as claimed in claim 17, wherein each transverse part has opposing trenches in the rear holding room thereof, and the second circuit boards are tightly inserted into the opposing trenches at edges thereof.

19. The integrated advertisement board as claimed in claim 17, wherein each vertical part has opposing trenches in the holding room thereof, and the third circuit boards are tightly inserted into the opposing trenches at edges thereof.

20. The integrated advertisement board as claimed in claim 16, wherein each transverse part has a connecting protrusion, and an engaging protrusion formed along a bottom thereof, and a connecting groove, and an engaging groove formed along a top thereof, and the transverse parts are joined together, one on top of another, with the connecting protrusions, and engaging protrusions being inserted into adjacent connecting grooves, and adjacent engaging grooves respectively.

21. The integrated advertisement board as claimed in claim 16, wherein each light emitting element consists of:

a base having a holding room on a rear side thereof, and a cover for covering the holding room thereof; the base having a transparent inner shell projecting from a front side thereof and in communication with the holding room; the inner shell having a rear connecting portion;

an LED; the LED being joined to a first circuit board of the controlling circuit by means of welding; the first circuit board being disposed in the holding room with the LED being disposed in the inner shell; and a transparent spherical shell disposed around the inner shell and joined to the rear portion of the inner shell for cooperating with the outer shell to concentrate light emitted from the LED;

each transverse part having a front gap in front of the front holding room thereof; the inner shells projecting from the front gaps of the transverse parts.

22. The integrated advertisement board as claimed in claim 21, wherein each LED is a tri-color one, which can emit red, green, and blue lights; strength of the red, green, and blue lights emitted from each LED being made to change by means of a driving circuit for the LED so that color of the LED changes accordingly.

23. The integrated advertisement board as claimed in claim 21, wherein the rear portion of the inner shell, and the spherical outer shell have threads on inner, and outer sides thereof respectively, and are securely screwed to each other by means of the threads.

24. The integrated advertisement board as claimed in claim 21, wherein each base has a gap in communication with the holding room thereof, and a socket is joined to each first circuit board, and projects from the gap of a corresponding base for connection with a wire connected to other circuit boards of the controlling circuit.

25. The integrated advertisement board as claimed in claim 16, wherein the controlling circuit includes:

a chief controller in a form of a microprocessor;

a chief memory electrically connected to the chief controller; the chief memory being used for storing digital data, which are transformed from various patterns to be presented with the light emitting elements; and a plurality of column controllers electrically connected to the chief controller, and respective driving circuits; each driving circuit being connected to a column of light emitting elements; the column controllers being provided to make corresponding driving circuits function to activate corresponding column of light emitting elements such that each light emitting element begins emitting light and stop emitting light in an alternate way, and in turns, patterns are presented on the advertisement board with each light emitting element beginning and stopping emitting light in an alternate way.

26. The integrated advertisement board as claimed in claim 25, wherein the controlling circuit includes a subsidiary memory electrically connected to the chief controller, and every LED is a tri-color one, which can emit red, green, and blue lights; the subsidiary memory being used for storing digital data, which are transformed from data related to colors of various portions of a pattern, and the way of presenting the pattern with the light emitting elements; the driving circuits and the column controllers being capable of working together to make strength of the red, green, and blue lights emitted from each light emitting diode change constantly according to data stored in the subsidiary memory; thus, a pattern is presented with constantly changing colors with the red, green, and blue lights of each light emitting diode mixing together.

27. The integrated advertisement board as claimed in claim 25, wherein a light sensing device is electrically connected to the chief controller for finding out whether it is so dark that the advertisement board should be activated for use, and operates according to a fact found out therewith.

28. The integrated advertisement board as claimed in claim 27, wherein the light sensing device is set up so as to make the chief controller stay in either one of an activated status and a not-activated status for a predetermined length of time after it has been switching the chief controller on and off in an alternate way for predetermined numbers of times, thus not going to activate and stop activating the controller in the alternate way for extended lengths of time during certain portions of a day.

29. The integrated advertisement board as claimed in claim 28, wherein the controlling circuit is equipped with first radio receiver and radio transmitter, both connected to the chief controller, and a remote control is provided for working with the first radio receiver and radio transmitter; the remote control consisting of a controlling unit, a plurality of buttons, a memory, and second radio receiver and radio transmitter; the remote control being operable with the buttons to transmit data in the memory of the remote control to the chief memory via the second radio transmitter as well as the first radio receiver, thus making a copy of the data in the chief memory.

30. The integrated advertisement board as claimed in claim 29, wherein the remote control can be operated with the buttons to transmit data in the chief memory to the memory of the remote control via the first radio transmitter as well as the second radio receiver, thus making a copy of the data in the memory of the remote control.

31. An integrated advertisement board, comprising:

a frame;

a plurality of light emitting elements arranged on the frame in a form of a matrix; and a controlling circuit electrically connected to the light emitting elements for making each light emitting element emit light and stop emitting light in an alternate way for the light emitting elements to present patterns having constantly changing appearance; the controlling circuit being capable of being set up such that different lines of light emitting elements take turns emitting light; and being characterized by the controlling circuit, which includes:

a chief controller in a form of a microprocessor;

a subsidiary memory electrically connected to the chief controller, every LED being a tri-color LED, which can emit red, green, and blue lights, the subsidiary memory being used for storing digital data, which are transformed from data related to colors of various portions of a pattern, and the way of presenting the pattern with the light emitting elements;

a chief memory electrically connected to the chief controller; the chief memory being used for storing digital data, which are transformed from various patterns to be presented with the light emitting elements; and a plurality of column controllers electrically connected to the chief controller, and respective driving circuits; each driving circuit being connected to a column of light emitting elements; the column controllers being provided to make corresponding driving circuits function to activate corresponding column of light emitting elements such that each light emitting element begins emitting light and stop emitting light in an alternate way, and in turns, patterns are presented on the advertisement board with each light emitting element beginning and stopping emitting light in an alternate way, the driving circuits and the column controllers being capable of working together to make an intensity of the red, green, and blue lights emitted from each light emitting diode change constantly according to data stored in the subsidiary memory, wherein a pattern is presented with constantly changing colors with the red, green, and blue lights of each light emitting diode mixing together.

32. The integrated advertisement board as claimed in claim 31, wherein a light sensing device is electrically connected to the chief controller for finding out whether it is so dark that the advertisement board should be activated for use, and operates according to a fact found out therewith.

33. The integrated advertisement board as claimed in claim 32, wherein the light sensing device is set up so as to make the chief controller stay in either one of an activated status and a not-activated status for a predetermined length of time after it has been switching the chief controller on and off in an alternate way for predetermined numbers of times, thus not going to activate and stop activating the controller in the alternate way for extended lengths of time during certain portions of a day.

34. The integrated advertisement board as claimed in claim 31, wherein the controlling circuit is equipped with first radio receiver and radio transmitter, both connected to the chief controller, and a remote control is provided for working with the first radio receiver and radio transmitter; the remote control consisting of a controlling unit, a plurality of buttons, a memory, and second radio receiver and radio transmitter; the remote control being operable with the buttons to transmit data in the memory of the remote control to the chief memory via the second radio transmitter as well as the first radio receiver, thus making a copy of the data in the chief memory.

35. The integrated advertisement board as claimed in claim 34, wherein the remote control can be operated with the buttons to transmit data in the chief memory to the memory of the remote control via the first radio transmitter as well as the second radio receiver, thus making a copy of the data in the memory of the remote control.

36. The integrated advertisement board as claimed in claim 31, wherein each light emitting element consists of:

a base having a holding room on a rear side thereof, and a cover for covering the holding room thereof; the base having a transparent inner shell projecting from a front side thereof and in communication with the holding room; the inner shell having a rear connecting portion;

an LED; the LED being joined to a first circuit board of the controlling circuit by means of welding; the first circuit board being disposed in the holding room with the LED being disposed in the inner shell; and a transparent spherical shell having an opening; the spherical shell being passed over the inner shell at the opening and joined to the rear portion of the inner shell for cooperating with the outer shell to concentrate light emitted from the LED twice.

37. The integrated advertisement board as claimed in claim 36, wherein each LED is a tri-color one, which can emit red, green, and blue lights; strength of the red, green, and blue lights emitted from each LED being made to change by means of a driving circuit for the LED so that color of the LED changes accordingly.

38. The integrated advertisement board as claimed in claim 36, wherein the rear portion of the inner shell, and the spherical outer shell have threads on inner, and outer sides thereof respectively, and are securely screwed to each other by means of the threads.

39. The integrated advertisement board as claimed in claim 36, wherein each base has a gap in communication with the holding room thereof, and a socket is joined to each first circuit board, and projects from the gap of a corresponding base for connection with a wire connected to other circuit boards of the controlling circuit.

40. The integrated advertisement board as claimed in claim 31, wherein the frame consists of:

a plurality of transverse parts arranged one on top of another, and a pair of vertical parts joined to respective ones of two ends of the transverse parts;

each transverse part having a front holding room for holding the light emitting elements in position; each vertical part having a connecting room for holding respective ends of the transverse parts in position.

41. The integrated advertisement board as claimed in claim 40, wherein each transverse part has a rear holding room formed therealong, and a middle gap between the front and the rear holding rooms, and second circuit boards are held in the rear holding rooms, and each vertical part has a holding room, and a gap between the connecting room and the holding room thereof while third circuit boards are disposed in the holding rooms of the vertical parts; wires being passed through the middle gap of each transverse part to connect a first circuit board to the second of circuit boards; wires being passed through the gap of each vertical part to connect the second circuit boards to the third circuit boards.

42. The integrated advertisement board as claimed in claim 40, wherein each transverse part has a rear holding room, which is formed with opposing trenches therein, and the second circuit boards are tightly inserted into the opposing trenches at edges thereof.

43. The integrated advertisement board as claimed in claim 40, wherein each vertical part has a holding room, which is formed with opposing trenches therein, and the third circuit boards are tightly inserted into the opposing trenches at edges thereof.

44. The integrated advertisement board as claimed in claim 40, wherein each transverse part has a connecting protrusion, and an engaging protrusion formed along a bottom thereof, and a connecting groove, and an engaging groove formed along a top thereof, and the transverse parts are joined together, one on top of another, with the connecting protrusions, and engaging protrusions being inserted into adjacent connecting grooves, and adjacent engaging grooves respectively.

45. An integrated advertisement board, comprising:

a frame;

a plurality of light emitting elements arranged on the frame in a form of a matrix; and a controlling circuit electrically connected to the light emitting elements for making each light emitting element emit light and stop emitting light in an alternate way for the light emitting elements to present patterns and for the patterns to have constantly changing appearance; and being characterized by the frame, which includes:

a plurality of transverse parts arranged one on top of another, and a pair of vertical parts joined to respective ones of two ends of the transverse parts;

each transverse part having a holding room for holding at least two circuit boards of the controlling circuit therein.

* * * * *